US007299783B1

(12) United States Patent
Broman et al.

(10) Patent No.: US 7,299,783 B1
(45) Date of Patent: Nov. 27, 2007

(54) AUXILIARY CONTROL OF AIRFLOW THROUGH AN ENGINE ENCLOSURE OF AN OUTBOARD MOTOR

(75) Inventors: Jeffrey J. Broman, West Bend, WI (US); Eric S. Mueller, Fond du Lac, WI (US); Paul M. Radavich, Eldorado, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/359,693

(22) Filed: Feb. 22, 2006

(51) Int. Cl.
*F02B 77/00* (2006.01)

(52) U.S. Cl. ..... 123/198 E; 440/77; 440/88 A

(58) Field of Classification Search ..... 123/198 E; 440/77, 88 A
See application file for complete search history.

(56) References Cited

U.S. PATENT DOCUMENTS

| | | | | |
|---|---|---|---|---|
| RE33,050 | E * | 9/1989 | Tuggle et al. | 15/330 |
| 5,370,563 | A * | 12/1994 | Yamazaki et al. | 440/77 |
| 5,445,547 | A * | 8/1995 | Furukawa | 440/77 |
| 5,937,818 | A * | 8/1999 | Kawai et al. | 123/198 E |
| 5,996,546 | A | 12/1999 | Kollmann et al. | 123/195 C |
| 6,024,616 | A * | 2/2000 | Takayanagi | 440/77 |
| 6,346,018 | B1 * | 2/2002 | Watanabe | 440/77 |
| 6,413,131 | B1 * | 7/2002 | Phillips et al. | 440/88 R |
| 6,439,938 | B1 * | 8/2002 | Katayama | 440/88 R |
| 6,604,968 | B2 * | 8/2003 | Wada et al. | 440/88 A |
| 6,645,021 | B1 * | 11/2003 | Kawai et al. | 440/76 |
| 6,875,066 | B2 * | 4/2005 | Wolaver | 440/77 |
| 6,899,579 | B1 * | 5/2005 | Bruestle | 440/88 A |
| 7,021,262 | B1 * | 4/2006 | Belter et al. | 123/184.47 |
| 2002/0031961 | A1 * | 3/2002 | Katayama | 440/77 |
| 2003/0054708 | A1 * | 3/2003 | Yoshioka et al. | 440/53 |
| 2005/0191915 | A1 * | 9/2005 | Nakamura | 440/77 |
| 2006/0101837 | A1 * | 5/2006 | Manole | 62/259.2 |
| 2006/0223392 | A1 * | 10/2006 | Noda et al. | 440/88 A |
| 2006/0258232 | A1 * | 11/2006 | Gongwer | 440/38 |
| 2006/0258234 | A1 * | 11/2006 | Ito | 440/77 |

* cited by examiner

*Primary Examiner*—Stephen K. Cronin
*Assistant Examiner*—Katrina Harris
(74) *Attorney, Agent, or Firm*—William D. Lanyi

(57) ABSTRACT

A marine propulsion device is provided with an air control system that draws air from the region under the cowl of the outboard motor and induces a flow of air out of the region. The air is caused to flow through a second opening formed in the cowl. As a result, air drawn into the cowl through a first opening can flow either into the engine through its throttle body mechanism or out of the space under the cowl, as induced by the operation of the fan.

18 Claims, 2 Drawing Sheets

AUXILIARY CONTROL OF AIRFLOW THROUGH AN ENGINE ENCLOSURE OF AN OUTBOARD MOTOR

BACKGROUND OF THE INVENTION

1. Field of the Invention

The present invention is generally related to a cooling system for an outboard motor and, more particularly, to a system that causes additional air flow through the enclosure of an outboard motor to provide additional cooling of an engine.

2. Description of the Related Art

Those skilled in the art of outboard motors are familiar with the various techniques for controlling the air flow into the space under a cowl of the outboard motor. Typically, air is directed from a location outside of the cowl of an outboard motor, through an opening and into the space under the cowl. That air is directed into the region surrounding the engine of the outboard motor and, eventually, into the air intake manifold of the engine.

U.S. Pat. No. 5,445,547, which issued to Furukawa on Aug. 29, 1995, describes an outboard motor having an engine compartment covered by an engine cover at its top portion and having an engine disposed within the engine compartment with its crankshaft directed in the vertical direction, in which charging efficiency of the engine is improved with a simple structure and a shielding property of the entire surrounding of the engine is also enhanced. A suction chamber communicating with an intake section of the engine is disposed on a surface other than the top surface of the engine and on one side of the inside of the engine compartment, an air intake port is provided in the engine cover at a position close to the other side of the inside of the engine compartment, an air exhaust port is provided in the engine cover, and a duct is provided within the engine compartment for leading air from the air intake port towards the suction chamber while making a detour to avoid a route above the engine.

U.S. Pat. No. 5,937,818, which issued to Kawai et al. on Aug. 17, 1999, describes a ventilation system for an outboard motor. An engine has an output shaft arranged to drive the propulsion device. The ventilating system includes an air inlet in the cowling which permits air to flow into an engine compartment in which the engine is positioned, and an exhaust port positioned in the cowling. The system also includes a mechanism for drawing air through the inlet into the compartment and expelling air out of the compartment through the exhaust port after the engine has stopped.

U.S. Pat. No. 5,996,546, which issued to Kollmann et al. on Dec. 7, 1999, discloses an integrated flywheel cover and air conduit passage. A cover for an outboard motor is provided to protect an operator from a flywheel. The cover is disposed under the cowl of the outboard motor. The cover is made of a generally rigid material, such as plastic, with first and second sheets being associated together to form conduits with openings extending therefrom. In one particular embodiment, one of the openings is shaped to receive an inlet of a compressor and thus provides a positioning aid in attaching the cover to the engine. This device eliminates the need for flexible hoses and accomplishes two tasks with one component. It provides air conduits for the air passing through the cover and it provides a generally rigid means for locating the proper location of the cover.

U.S. Pat. No. 6,024,616, which issued to Takayanagi on Feb. 15, 2000, describes an engine cover of an outboard motor. The outboard motor includes an engine which is covered by an engine cover which is formed with a cylindrical air suction port having an opening opened to an upper surface of the engine cover in a state of the outboard motor mounted to a hull, and a portion of an opening area of the opening is covered by a lid member which is formed to a rear edge portion of the opening.

U.S. Pat. No. 6,413,131, which issued to Phillips et al. on Jul. 2, 2002, discloses an air flow system for an outboard motor. The outboard motor is provided with an air duct located within the cavity of a cowl of an outboard motor. The air duct defines a chamber within it in association with first and second openings that allow heated air to flow, through the creation of convection currents, out of the engine compartment under a cowl. This convection flow removes heat from fuel system components and reduces the likelihood that "vapor lock" will occur subsequent to the use of an internal combustion engine that is followed by turning the engine off.

U.S. Pat. No. 6,899,579, which issued to Bruestle on May 31, 2005, discloses a marine propulsion device with variable air intake system. An air flow control mechanism is provided to control the flow of air through an opening formed in a portion of a cowl of an outboard motor. The air flow control mechanism is configured to be movable between a first position and the second position to affect the magnitude of air flowing through an air passage defined as being the space between the opening formed in the cowl and an exit through which the air can leave the cavity of the cowl. The airflow control mechanism can control the flow of air as a function of an operating characteristic of the engine, such as its operating speed, the load on the engine, or the operating temperature of the engine.

The patents described above are hereby expressly incorporated by reference in the description of the present invention.

It would be significantly beneficial if a system could be provided that improves the circulation of air through the space under a cowl of an outboard motor and which does not rely solely on the natural movement of the air under the influence of convention currents, or the forward movement of the outboard motor, when an associated marine vessel is being operated on a body of water.

SUMMARY OF THE INVENTION

A marine propulsion system, made in accordance with a preferred embodiment of the present invention, comprises an engine, an enclosure surrounding the engine, first and second openings formed through first and second portions of the enclosure, respectively, and a powered air moving device disposed in fluid communication with the second opening and disposed to cause air to flow through the second opening when the powered air moving device is activated. In a particularly preferred embodiment of the present invention, it further comprises a conduit extending from the second opening to a preselected position within the enclosure. The powered air moving device is disposed in fluid communication with the conduit to cause air to flow through the conduit through the second opening and out of the enclosure.

In a particularly preferred embodiment of the present invention, the powered air moving device is a fan. The powered air moving device can be powered by an electric motor or mechanically driven by the engine and can be configured to draw air into or out of the enclosure and cause the air to flow through the second opening.

In a preferred embodiment of the present invention, the first opening may be higher than the second opening. The preferred embodiment of the present invention can further comprise a temperature sensor and a controller which is configured to control the operation of the powered air moving device as a function of a temperature sensed by the temperature sensor. The temperature sensor can be disposed in thermal communication with an intake manifold of the engine. The preferred embodiment of the present invention can further comprise a microprocessor connected in signal communication with a temperature sensor. The microprocessor can be configured to control the powered air moving device as a function of a temperature signal received from the temperature sensor. A preferred embodiment of the present invention can further comprise a timer connected in electrical communication with the powered air moving device to deactivate the powered air moving device after a preselected time interval following a predetermined event associated with the engine, such as the engine being turned off.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
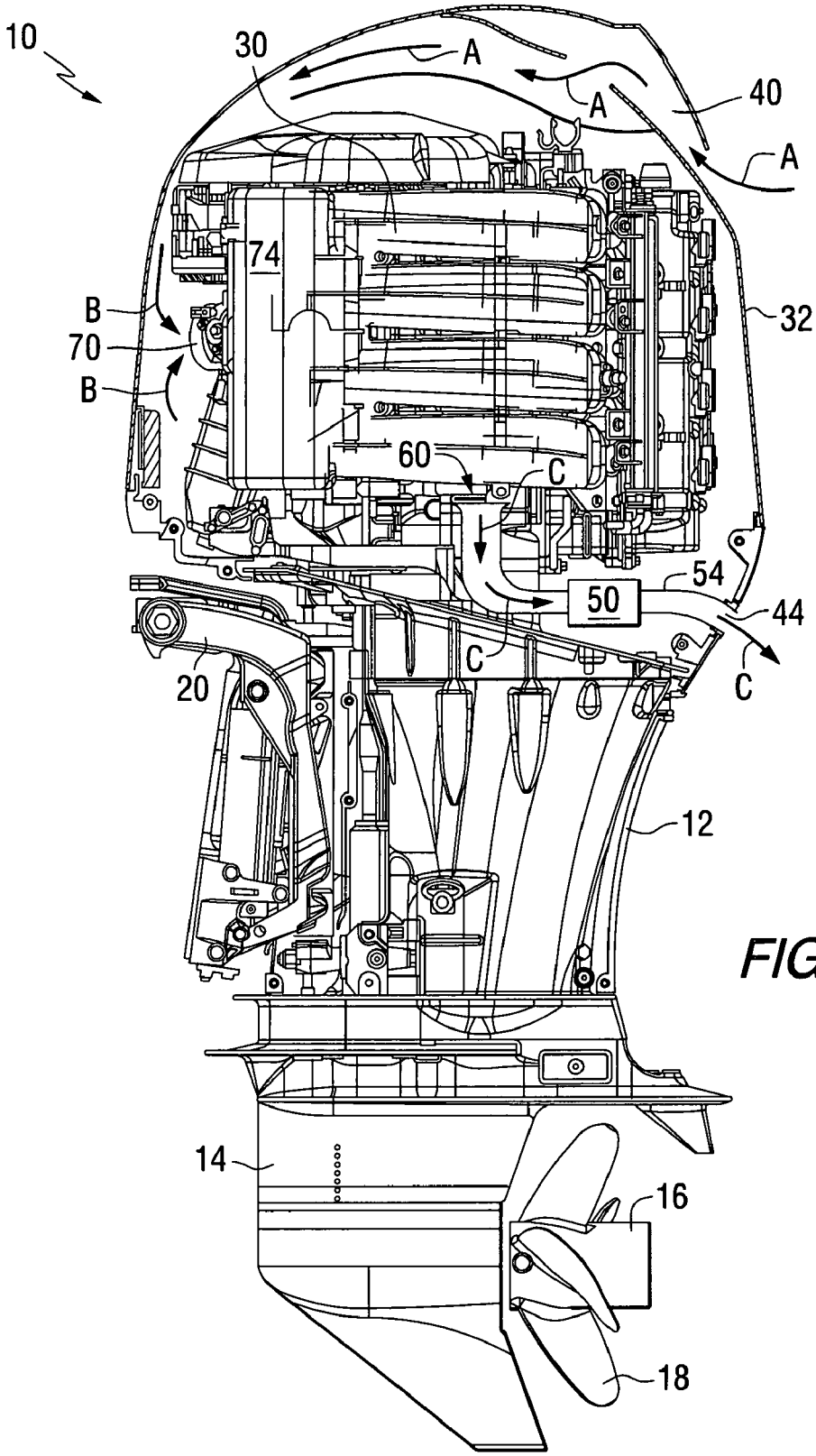
FIG. 1 is a side section view of an outboard motor in which the present invention is provided.

Throughout the description of the preferred embodiment of the present invention, like components will be identified by like reference numerals.

FIG. 1 shows an outboard motor 10. As is generally known to those skilled in the art, the outboard motor has a driveshaft housing 12 which supports a gear case 14. Although not shown in FIG. 1, those skilled in the art are also aware that the gear case 12 supports a generally vertical driveshaft which is connected in torque transmitting relation with a generally horizontal propeller shaft within the gear case 14. The generally horizontal propeller shaft supports a propeller 16 having a plurality of blades 18. The outboard motor is attached to a transom of a marine vessel by attaching a transom bracket 20 to the transom. An engine 30 is disposed under an enclosure, or cowl 32. In a preferred embodiment of the present invention, the cowl 32 is provided with a first opening 40 which is formed through a first portion of the enclosure 32. A second opening 44 is formed through a second portion of the enclosure 32. A powered air moving device 50 is disposed in fluid communication with the second opening 44 and disposed to cause air to flow through the second opening when the powered air moving device 50 is activated.

A conduit 54 extends from the second opening 44 to a preselected position 60 within the enclosure 32. The powered air moving device 50 is disposed in fluid communication with the conduit 54 to cause air to flow through the conduit, through the second opening 44, and out of the enclosure 32 as represented by the arrows illustrated in conjunction with the conduit 54 and second opening 44 in FIG. 1.

The powered air moving device 50 can be a fan which, in turn, can be powered by an electric motor or mechanical connection to the engine. The powered air moving device 50 is configured to draw air into or out of the enclosure 32 and cause the air to flow through the second opening 44.

During normal operation of the outboard motor 10, air is drawn through the first opening 40, as represented by arrows A, and toward a throttle body structure 70 of the engine 30. Some of this air is then directed through an air intake manifold 74 and toward the cylinders of the engine 30. The air flowing into and through the throttle body structure 70 is represented by arrows B in FIG. 1. In addition to the air B flowing into and through the throttle body mechanism 70, some of the air represented by arrows A flows around the engine and related components and removes heat. That additional air C flows into the conduit 54, at the position 60 within the enclosure 32 and is directed through the conduit 54 toward the second opening 44. The fan 50 causes this flow of air out of the enclosure 32 and through the second opening 44. It should be understood that if the second opening 44 is not provided, virtually all of the air flowing into the first opening 40 would flow through the throttle body mechanism 70 and into the engine 30 as represented by arrows B. However, as a result of the fan 50 and the resulting pressure differential, additional air A is drawn through the first opening 40 and caused to flow in thermal communication with the engine 30 and associated components and then flow out of the enclosure 32 through the second opening 44.

Figure 2:
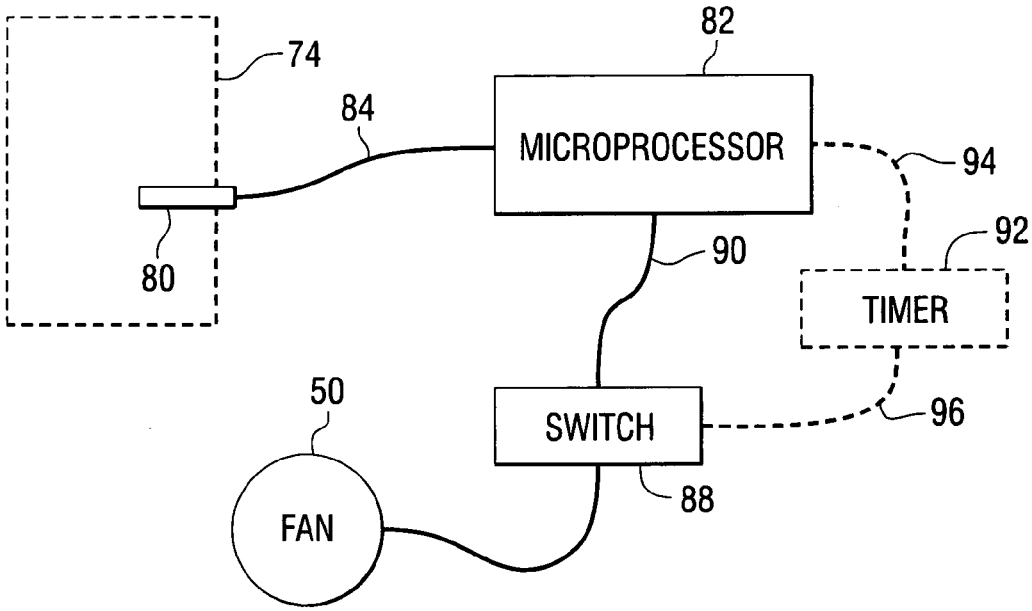
FIG. 2 is a simplified schematic of one particular embodiment of the present invention.

FIG. 2 is a highly simplified representation of several of the components of the present invention. The air intake manifold 74 is represented by dashed lines in FIG. 2. A temperature sensor 80 is disposed in thermal communication with the air intake manifold 74 to sense the temperature of the air flowing through the air intake manifold. In the embodiment represented by FIG. 2, a microprocessor 82 receives a signal on line 84 from the temperature sensor 80. That signal represents the temperature of air flowing into the engine. The microprocessor is connected in signal communication with a switch 88 by wire 90 so that the microprocessor 82 can control the operation of the fan 50. In FIG. 2, an alternate embodiment of the present invention is represented by the dashed lines showing a timer 92 connected in signal communication with both the microprocessor 82 and the switch 88 by lines 94 and 96, respectively. In other words, the timer 92 can be used under certain circumstances where the microprocessor 82 is unpowered because of the engine 30 being turned off. In those circumstances, the timer 92 can be configured to cause the fan 50 to continue to run for a preselected period of time. This provides an advantage of additionally cooling the engine after the outboard motor has been turned off, particularly if this deactivation of the outboard motor also deprives the microprocessor 82 of power.

Figure 3:
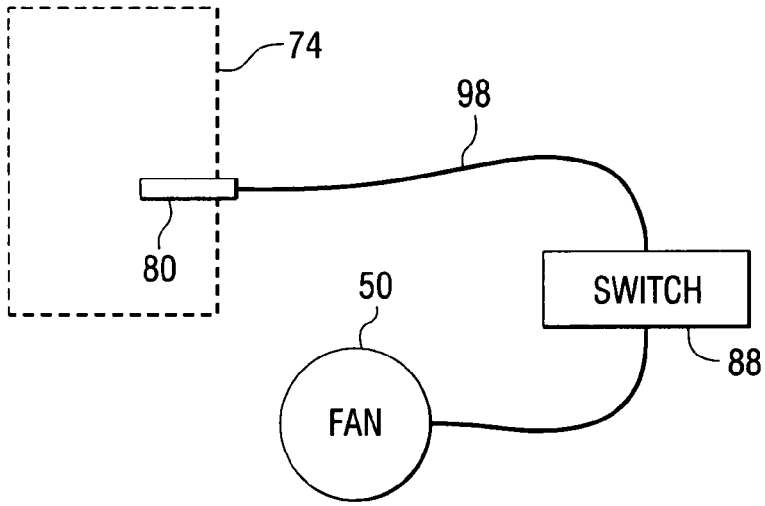
FIG. 3 is a simplified schematic representation of an alternative embodiment of the present invention.

FIG. 3 represents an embodiment of the present invention in which no microprocessor is provided. Instead, the temperature sensor 80 is connected directly to the switch 88 and provides control of the switch. If the temperature within the air intake manifold 74 is above a predetermined magnitude, the signal on line 98 causes the switch to allow the fan 50 to run. When the temperature within the air intake manifold 74 drops below the preselected threshold, the temperature sensor 80 provides a signal on line 98 to cause the switch 88 to deactivate the fan 50.

With reference to FIGS. 2 and 3, it should be understood that the control of the fan 50 can be accomplished by providing a preselected temperature threshold magnitude, or temperature threshold magnitude range, and causing the fan 50 to operate when the temperature sensed by the temperature sensor 80 is above that threshold or threshold range. The fan 50 would then be deactivated when the temperature within the air intake manifold 74 falls below the temperature threshold or range. As an example, if a single temperature threshold (e.g. 95 degrees Fahrenheit) is used, the switch would be controlled to operate the fan 50 when the temperature is above the threshold and to deactivate the fan 50 when the temperature is below the threshold. However, this type of simple system could result in frequent changes of the status of the fan 50, particularly when the actual temperature within the air intake manifold is very close to the single selected temperature threshold. If a temperature range is used, sufficient hysteresis can be provided so that the operational status of the fan isn't changed as frequently. Under a system of that type, the fan would be activated when the air intake temperature is above the upper limit of the temperature range and the fan would be deactivated when the temperature falls below the lower limit of the temperature range. If the temperature within the air intake manifold is between the upper and lower limits of the temperature range, no change in operational status of the fan would be made.

With references to FIGS. 1, 2 and 3, it can be seen that a preferred embodiment of the present invention provides a marine propulsion system that comprises an engine 30, a cowl structure 32 surrounding the engine 30, a first opening 40 formed through the cowl structure 32, a second opening 44 formed through the cowl structure 32, and a fan 50 disposed in fluid communication with a second opening 44 and disposed to cause air to flow through the second opening 44 when the fan is activated, as represented by arrows C. The fan is configured to draw air out of the cowl structure 32 and cause the air to flow through the second opening 44. A conduit 54 extends from the second opening 44 to a preselected position 60 within the cowl structure 32. The fan 50 is disposed in fluid communication with the conduit 54 to cause air to flow through the conduit 54 through the second opening 44 and out of the cowl structure 32. The fan 50 can be powered by an electric motor. The first portion, where the first opening 40 is located, is higher than the second portion where the second opening 44 is located. The preferred embodiment of the present invention can further comprise a temperature sensor 80 and a controller, such as the microprocessor 82, which is configured to control the operation of the fan 50 as a function of a temperature sensed by the temperature sensor 80. The temperature sensor 80 is disposed in thermal communication with an intake manifold 74 of the engine 30. A preferred embodiment of the present invention can further comprise the microprocessor 82 which is connected in signal communication with a temperature sensor 80. The microprocessor 82 can be configured to control the fan 50 as a function of a temperature signal received from the temperature sensor 80. A timer 92 can be provided and connected in electrical communication with the fan 50 to deactivate the fan after a predetermined time interval following a predetermined event associated with the engine, such as the engine being turned off. In addition, a one-way valve could be added to the conduit 54 between the air moving device 50 and the second opening 44 to prevent water from flowing into the area under the cowl.

Although the present invention has been described in particular detail and illustrated to show a preferred embodiment, it should be understood that alternative embodiments are also within the scope of the claims.

We claim:

1. A marine propulsion system, comprising:

an engine;

an enclosure surrounding said engine;

a first opening formed through a first portion of said enclosure;

a second opening formed through a second portion of said enclosure; and a powered air moving device disposed below said engine and in fluid communication with said second opening and disposed to cause air to flow through said second opening when said powered air moving device is activated, said powered air moving device being powered by an electric motor.

2. The system of claim 1, further comprising:

a conduit extending from said second opening to a preselected position within said enclosure, said powered air moving device being disposed in fluid communication with said conduit to cause air to flow through said conduit and out of said enclosure through said second opening.

3. The system of claim 1, wherein:

said powered air moving device is a fan.

4. The system of claim 1, wherein:

said powered air moving device is configured to draw air out of said enclosure and cause said air to flow through said second opening.

5. The system of claim 1, wherein:

said first portion is higher than said second portion;

said engine has a throttle body for receiving combustion air;

said throttle body is downstream of and lower than said first opening;

said throttle body is upstream of and higher than said second opening; and said throttle body is upstream of and higher than said powered air moving device.

6. The system of claim 1, further comprising:

a temperature sensor;

a controller configured to control the operation of said powered air moving device as a function of a temperature sensed by said temperature sensor.

7. The system of claim 6, wherein:

said temperature sensor is disposed in thermal communication with an intake manifold of said engine.

8. The system of claim 6, further comprising:

a microprocessor connected in signal communication with said temperature sensor, said microprocessor being configured to control said powered air moving device as a function of a temperature signal received from said temperature sensor.

9. The system of claim 1, further comprising:

a timer connected in electrical communication with said powered air moving device to deactivate said powered air moving device after a predetermined time interval following a predetermined event associated with said engine.

10. A marine propulsion system, comprising:

an engine;

a cowl structure surrounding said engine;

a first opening formed through said cowl structure;

a second opening formed through said cowl structure; and a powered air moving device disposed in fluid communication with said second opening and disposed to cause air to flow through said second opening when said powered air moving device is activated, said powered air moving device being configured to draw air out of said cowl structure and cause said air to flow through said second opening;

a timer connected in electrical communication with said powered air moving device to deactivate said powered air moving device after a predetermined time interval following a predetermined event associated with said engine;

said cowl structure having a forward end facing the direction of propulsion, and an aft end facing oppositely to said forward end, said second opening being at said aft end of said cowl structure.

11. The system of claim 10, further comprising:

a conduit extending from said second opening to a preselected position within said cowl structure, said powered air moving device being disposed in fluid communication with said conduit to cause air to flow through said conduit and out of said cowl structure through said second opening in a direction opposite to said direction of propulsion.

12. The system of claim 10, wherein:

said powered air moving device in a fan moving air therethrough along a given direction, said given direction being opposite to said direction of propulsion.

13. The system of claim 10, wherein:

said first portion is higher than said second portion;

said cowl structure has a forward end facing in the direction of propulsion, and has an aft end facing oppositely from said forward end, said aft end of said cowl structure extending downwardly from a top to a bottom;

said first opening is at said top of said aft end of said cowl structure;

said second opening is at said bottom of said aft end of said cowl structure.

14. The system of claim 10, further comprising:

a temperature sensor;

a controller configured to control the operation of said fan as a function of a temperature sensed by said temperature sensor.

15. The system of claim 14, wherein:

said temperature sensor is disposed in thermal communication with an intake manifold of said engine.

16. The system of claim 10, further comprising:

a microprocessor connected in signal communication with said temperature sensor, said microprocessor being configured to control said fan as a function of a temperature signal received from said temperature sensor.

17. A marine propulsion system, comprising:

an engine;

a cowl structure surrounding said engine;

a first opening formed through said cowl structure;

a second opening formed through said cowl structure;

a fan which is a powered air moving device powered by an electric motor and disposed in fluid communication with said second opening and disposed to cause air to flow through said second opening when said fan is activated, said powered air moving device being configured to draw air out of said cowl structure and cause said air to flow through said second opening;

a conduit extending from said second opening to a preselected position within said cowl structure, said fan being disposed in fluid communication with said conduit to cause air to flow through said conduit and out of said cowl structure through said second opening;

said cowl structure having a forward end facing in the direction of propulsion, and aft end facing oppositely from said forward end;

said first and second openings are on the same one of said ends of said cowl structure.

18. The system of claim 17, wherein:

said fan is disposed below said engine;

said engine has a throttle body receiving combustion air;

said throttle body is downstream of and below said first opening;

said throttle body is upstream of and above said fan;

said throttle body is upstream of and above said second opening;

said fan moves air therethrough along a given direction;

said given direction is opposite to said direction of propulsion;

said aft end of said cowl structure extends downwardly from a top to a bottom;

said first opening is at said top of said aft end of said cowl structure;

said second opening is at said bottom of said aft end of said cowl structure.

* * * * *